United States Patent [19]

Ise

[11] 4,402,651

[45] Sep. 6, 1983

[54] VACUUM GENERATING DEVICE

[76] Inventor: Yoji Ise, c/o Kabushiki Kaisha Myotolu Seisakusho, 6-18, Shimomaruko 2-Chome, Ota-Ku, Tokyo, Japan

[21] Appl. No.: 244,614

[22] Filed: Mar. 17, 1981

[30] Foreign Application Priority Data

Mar. 28, 1980 [JP] Japan ..... 55-41953[U]

[51] Int. Cl.[3] ..... F16K 11/07

[52] U.S. Cl. ..... 417/182; 137/271

[58] Field of Search ..... 417/182, 184, 187; 137/269, 270, 271

[56] References Cited

U.S. PATENT DOCUMENTS

| | | | |
|---|---|---|---|
| 1,842,500 | 1/1932 | Beede | 417/187 |
| 2,966,168 | 12/1960 | Hunt | 137/270 |
| 3,613,715 | 10/1971 | Johnson | 137/271 |
| 3,993,165 | 11/1976 | Pottrich | 137/270 |

*Primary Examiner*—Alan Cohan

*Attorney, Agent, or Firm*—Murray Schaffer

[57] ABSTRACT

A device for obtaining a vacuum by jetting compressed air characterized in that compressed air, that is, a vacuum state can be switched by changing the internal member fitting position so as to be in a form in response to the use and the manufacture is very easy.

13 Claims, 3 Drawing Figures

VACUUM GENERATING DEVICE

This invention relates to a vacuum generating device whereby a vacuum is obtained by means of an ejector pump utilizing compressed air from a compressor provided in any factory without using a large costly vacuum pump. In the present invention, compressed air is fed and stopped by means of a switching valve operated by a solenoid or the like. It is free to be formed so that copressed air will be fed from a compressor to an ejector in case no electric current is passed through the solenoid or the like but will be stopped when an electric current is passed through the solenoid (which shall be said hereinafter to be normally opened) or that, on the contrary, compressed air will be stopped unless an electric current is passed through the solenoid but will be fed when a current is passed through the solenoid (which shall be said hereinafter to be normally closed). The present invention is characterized in that such formation can be simply made by changing the internal member fitting position, that the vacuum source device of the present invention has a controlling means, is compact, is very easy to make and can be cheaply provided.

In various automation apparata, suction pads are used to convey or hold various articles. That is to say, any article can be conveyed or held by a suction pad by pushing the suction pad against the article having a flat smooth surface and making a vacuum within the suction pad. However, there has been a defect that the so-called conventionally provided vacuum pump is large and costly.

The present invention relates to a vacuum generating device utilizing compressed air from a compressor provided in any factory. It is possible to simply change its internal structure in response to the use.

The above-mentioned features and other advantages of the present invention will become apparent from the following detailed explanation relating to the embodiments shown in the accompanying drawings in which.

Figure 1:
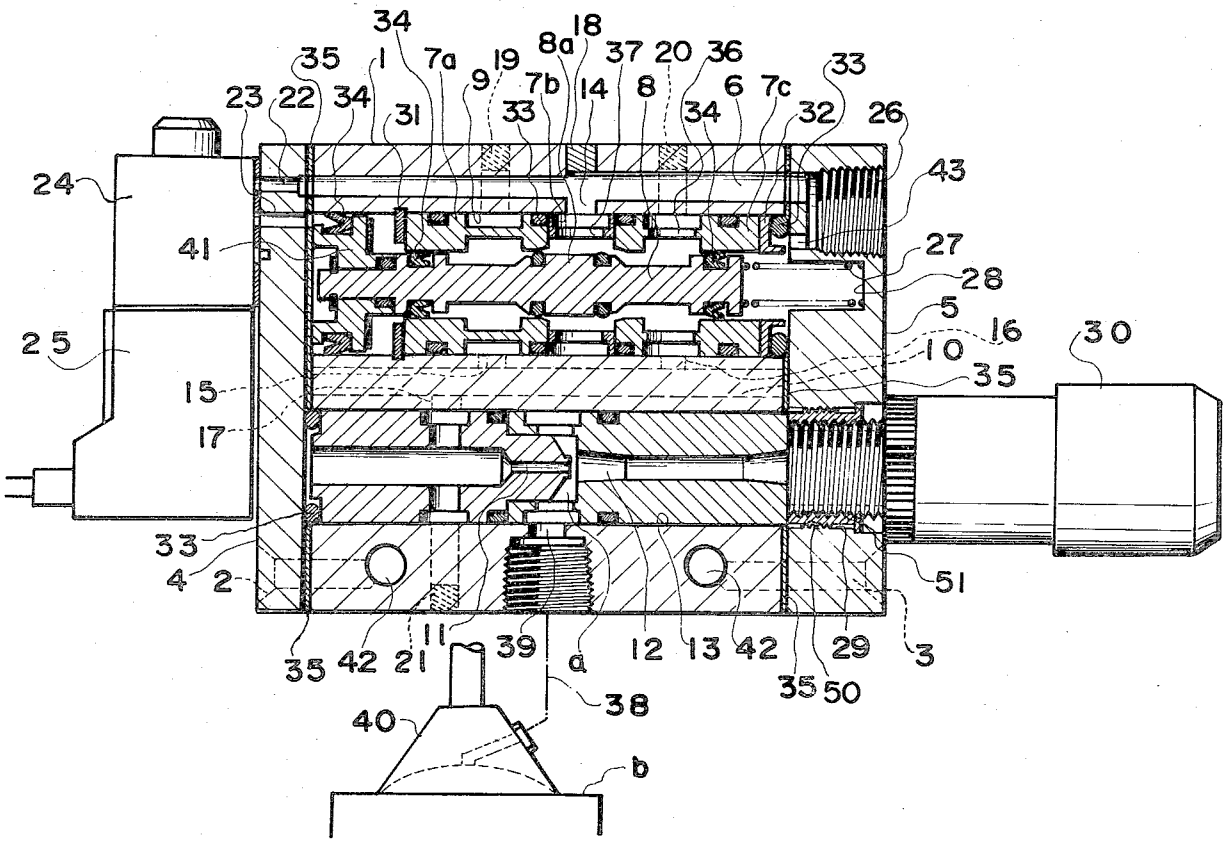
FIG. 1 is a vertically sectioned view of the apparatus of the present invention.

The present invention is formed of a body 1 containing a controlling means and ejector pump and fastening plates 4 and 5 removably fitted on both sides of the body 1 with screws 2 and 3.

First of all, a compressed air feeding path 6 is provided in the lateral direction within the body 1. A parallel lateral hole 9 is further provided and fitted with sleeves *7a*, *7b* and *7c* and an internal spool 8. A plenum chamber forming a switching path 10 is also provided in the lateral direction, as is a lateral hole 13 fitted with a nozzle body 11 forming a venture device having an ejector pump and a conically bored body 12 all parallel with the compressed air feeding path 6. Further, there is provided a hole 14 connecting the lateral hole 9 with the feeding path 6; holes 15 and 16 connecting the lateral hole 9 with the switching path 10; a connecting discharge hole 17 connecting the nozzle body 11 with the switching path 10, and; a through hole 39 for connecting a suction hose 38 to a partition chamber a formed between the nozzle body 11 and conical hole body 12.

According to the present invention, the above mentioned feeding path 6, lateral hole 9, switching path 10 and lateral hole 13 can be simply formed by boring from the sides of the fastening plates 4 and 5. The connecting holes 14, 15, 16 and 17 formed by vertically boring from the upper and lower surfaces seen in FIG. 1 and applying plugs 18, 19, 20 and 21.

Further, the fastening plate 4 is provided a passing hole 22 fitting the compressed air feeding path 6 and with a passing hole 23 fitting the lateral hole 9. A three-way switching valve 24 and a solenoid 25 driving it are provided on the outside surface of the fastening plate 4, in communication with the passing holes 22,23.

The other fastening plate 5 is provided with a threaded compressed air feeding port 26 fitting the compressed air feeding path 6, a passing hole 43 connecting from said feeding port 26 to the lateral hole 9, a recessed hole 28 receiving a spring 27 abutting one end of the spool 8 and a compressed air exhaust port 29 having a female screw 50. A silencing muffler 30 is fitted to the female screw 50 through a nut 51.

In the drawings, 31 and 32 are sleeve pressing rings, 33 is an O-ring, 34 is a seal ring, 35 is a seal packing, 40 is a suction pad, 41 is a piston formed on the spool 8 and 42 is a fitting hole.

Figures 2, 3:
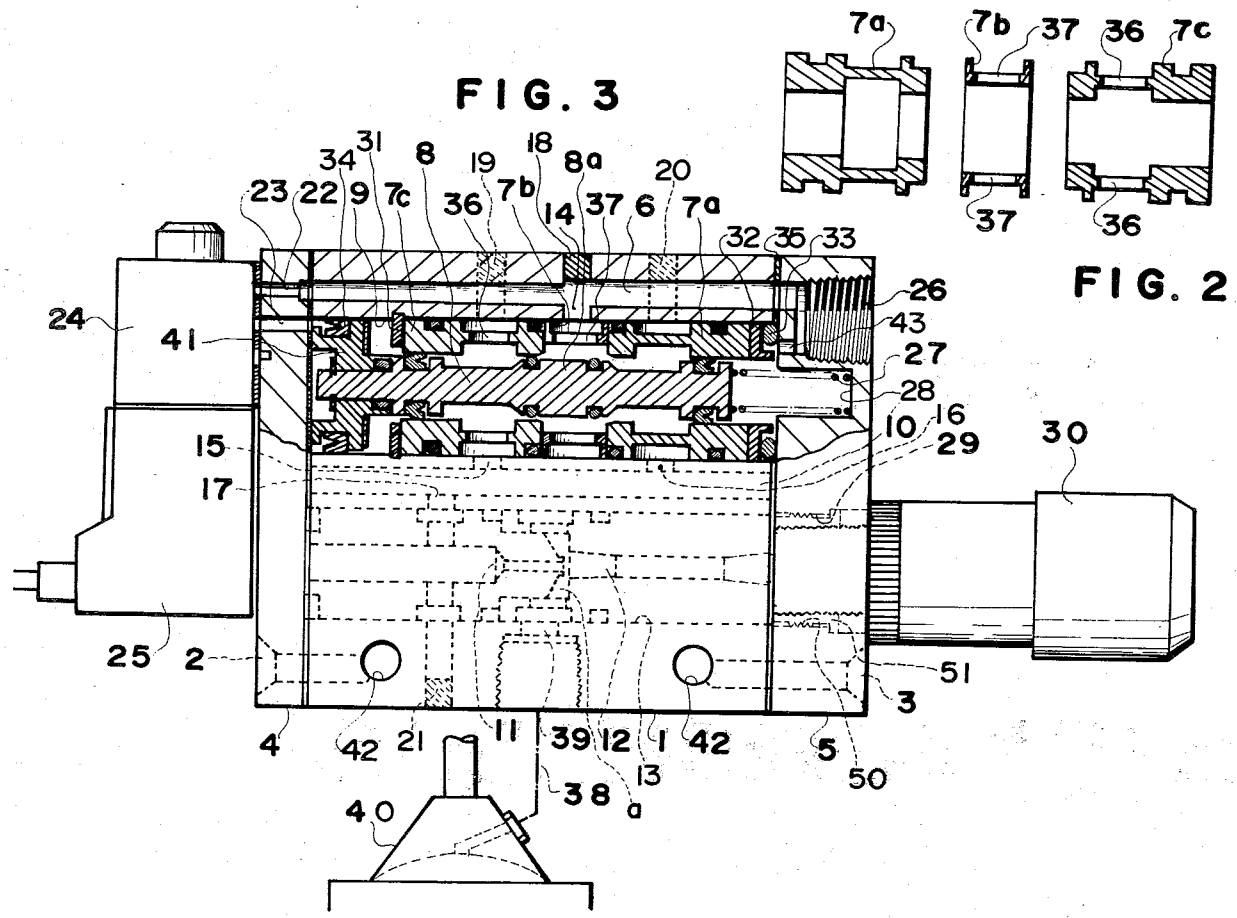
FIG. 2 is a vertically sectioned view of the valve sleeve body as disassembled.
FIG. 3 is a vertically sectioned view similar to FIG. 1 showing another embodiment.

The sleeves *7a*, *7b* and *7c* and spool 8 of the present invention shall now be described. As illustrated in FIG. 2, the sleeve body is divided into three sleeves *7a*, *7b* and *7c*. Sleeves *7a* and *7c* are formed in the same shape but only sleeve *7c* is provided with radial connecting holes 36. The sleeve *7b* is held between the sleeves *7a* and *7c* and is provided with radial connecting holes 37. Needless to say, the sleeve *7b* may be formed integrally with one or the other of the sleeves sleeve, that is either, the sleeve *7a* or *7c*.

The spool 8 which is set within the three connected sleeves *7a*, *7b* and *7c*, has a thick part *8a* formed substantially in the middle and is so formed so as to seal on one side the inner end of either one or the other the sleeve *7a* or *7c* when moved in the appropriate direction.

The present invention of the above mentioned formation can be used as normally opened and normally closed as required.

FIG. 1 shows the device as normally opened. That is to say, in FIG. 1, the passing holes 22 and 23 provided in the fastening plate 4 are closed by the three-way switching valve 24 and the spool 8 is biased leftward by the spring 27. Thus when compressed air is fed into the feeding port 26, it will pass through the connecting hole 14 and the connecting holes 37 of the sleeve *7b*, around the periphery of the spool 8, through the connecting holes 36 of the sleeve *7c*, the connecting hole 16, switching path 10 and connecting hole 17 will be jetted toward the conical hole body 12 out of the nozzle body 11. A negative pressure will consequently be made within the partition chamber a and, air in the through hole 39, suction hose 38 and suction pad 40 will be sucked and exhausted through the muffler 30, The workpiece b will be sucked and held by the suction pad 40 and will be able to be moved or fixed.

In case the work b has been moved and the suction is to be released, an electric current is passed through the solenoid to operate the three-way switching valve 24. Compressed air will vent, passing through the passing hole 22 of the fastening plate 4, the three-way switching valve 24 and passing hole 23 from the feeding path 6. Consequently the piston 41 of the spool 8 will be pushed rightward in the drawing, moving the spool 8. The thick part 8*a* of the spool 8 will then close the inside end of the sleeve 7*c*. The feed of compressed air to the nozzle body 11 will be interrupted, the partition chamber a will be under no negative pressure, and air will flow in also from the conically bored body 12 and the suction on the workpiece b by the suction pad 40 will be released.

The use of the device in the normally closed mode shall now be described. As illustrated in FIG. 3, the sleeves 7*a* and 7*c* may be arranged reversely to each other within the through hole 9. In the present invention, this change can be very easily made as the fastening plates 4 and 5 are removably fitted to the body 1 with the screws 2 and 3.

As a result, when the passing holes 22 and 23 provided in the fastening plate 4 are closed by the three-way switching valve 24 as mentioned above, even if compressed air is fed to the feeding port 26 and feeding path 6, it will not be fed to the nozzle body 11.

Now, when it is required to suck the work b, if an electric current is passed through the solenoid to operate the three-way switching valve 24, compressed air will pass through the passing hole 22 of the fastening plate 4, the three-way switching valve 24 and passing hole 23 from the feeding path 6. This will push the piston 41 of the spool 8 rightward in the drawing, the spool 8 will be moved. The left end of the thick part 8*a* of the spool 8 will then separate from the inside end of the sleeve 7*c* but the right end of the thick part 8*a* will seat on the inside of sleeve 7*a*. Compressed air will pass through the feeding path 6, connecting hole 14 and the connecting holes 37 of the sleeve 7*b*, around the periphery of the spool 8 and through the connecting holes 36 of the sleeve 7*c*, the connecting hole 15, switching path 10 and connecting hole 17 and will be jetted toward the conical hole body 12 out of the nozzle body 11. The partition chamber a will then be under a negative pressure and air will be sucked in the through hole 39, suction hose 38 and suction pad 40 and exhausted through the muffler 30. The workpiece b will be sucked by the suction pad 40 and will be able to be moved or fixed.

In case the suction on the workpiece b is to be released, the electric current passed to the solenoid is interrupted. The three-way switching valve 24 will be returned to the original state, and the spool 8 will be returned by the return spring 27. Compressed air to the nozzle body 11 part will consequently be interrupted.

As mentioned above, according to the present invention, as the sleeve body is divided, one device can be used as normally opened or; normally closed in response to the devised use. Further, as the removable fastening plates are fitted to both sides of the body, the body can be simply made by mere boring. Thus the device can be provided very cheaply.

What I claim is:

1. A valve assembly comprising a body, a bore formed in said body having an inlet adapted for connection to a flow of air under pressure and a pair of spaced outlets each offset axially on opposite sides of said inlet, a spool located within said bore, a sleeve surrounding said spool, and means for moving said spool relative to said sleeve between opposed axial positions, said sleeve comprising a central section having a lateral port adapted to register with the inlet to said bore, and a pair of substantially identical end sections at least one of which is separate from said central section, one of said end sections having a lateral port permitting through flow, the other being blanked so as to prevent through flow, said end sections being interchangeable about said spool to selectively arrange said one end section having the radial port in registry with a selected one of the outlet ports, and the other end section in registry with the other outlet port said spool and each of said end sections having cooperating seal means to selectively permit or block flow from said central section to said selected outlet on corresponding axial positioning of said spool.

2. The assembly according to claim 1, wherein said spool is a double spool having a central enlarged section and seal rings located on said central section spaced from each other, and said end sections of said sleeves having a seat on their internal surface for cooperation with said seal rings.

3. The assembly according to claim 2 wherein said means for moving said spool comprises a piston actuable by the flow through said inlet, and switch means for selectively directing said flow to said piston.

4. The valve assembly according to claim 3 wherein said outlets are connected to a venturi ejection pump thereby generating a vacuum.

5. A vacuum generating device comprising a body having an inlet passage adapted for connection to a source of compressed air, a bore connected to said inlet passage having a pair of spaced outlets each axially offset on opposite sides of the connection to said passage, a spool located within said bore, a sleeve surrounding said spool and means for moving said spool relative to said sleeve between opposed axial positions, said sleeve comprising a central section having a lateral port adapted to register with the inlet to said bore, and a pair of substantially identical end sections at least one of which is separate from said central section, one of said end sections having a lateral port permitting through flow, the other being blanked so as to prevent through flow, said end sections being interchangeable about said spool to selectively arrange said one end section having the radial port in registry with a selected one of the outlet ports, and the other end section in registry with the other outlet port, said spool and each of said end sections having cooperating seal means to selectively permit or block flow from said central section to said selected outlet on corresponding axial positioning of said spool, a plenum chamber formed in said body and communicating with each of the outlets of said bore to receive air therefrom and having a discharge port, a pump chamber formed in said body in communication with said discharge port having venturi means located therein for generating a vacuum on passage of air therethrough, said pump chamber having an air exhaust and an air inlet for drawing air therein.

6. The vacuum generating device according to claim 5 wherein said inlet passage, said bore, said plenum chamber, and said pump chamber are each formed of holes extending through said body parallel to each other and in a substantially common plane, and said communicating outlets and ports are formed of transverse holes formed in said body.

7. The vacuum generating device according to claim 6 including removable end plates for covering the ends of said parallel holes, said end plate being provided with means for removably connecting the source of air under pressure.

8. The vacuum generating device according to claim 7 including spring means for normally biasing said spool in one axial direction and means actuable to move said spool against the bias in the other direction comprising a piston located in said bore in engagement with said spool and means for selectively directing the flow from the inlet passage to said piston comprising a manifold formed in said end plate opposite the connection to the source of compressed air, said manifold communicating with the inlet passage and said bore, and having switch means for selectively permitting flow of air therethrough.

9. The vacuum generating device according to claim 8 wherein said switch means includes a solenoid.

10. The vacuum generating device according to claim 7 including a muffler mounted on one of said end plates in communication with the exhaust from said venturi device.

11. The vacuum generating device according to claim 6 wherein said venturi device comprises a nozzle in communication with said plenum chamber, and a cylindrical member spaced therefrom and having a central conical bore, both said nozzle and said cylindrical member being removably inserted with its associated hole.

12. The assembly according to claim 1 including spring means for normally biasing said spool in one axial direction and means actuable to move said spool against said bias in said other axial direction.

13. The assembly according to claim 2 including spring means for normally biasing said spool in one axial direction and means actuable to move said spool against said bias in said other axial direction.

* * * * *